United States Patent [19]

Hinley

[11] Patent Number: 4,963,156

[45] **Date of Patent: * Oct. 16, 1990**

[54] TANNING AGENT AND PROCESS

[75] Inventor: John J. Hinley, Middlesbrough, England

[73] Assignee: Tioxide Group PLC, London, England

[ * ] Notice: The portion of the term of this patent subsequent to Mar. 15, 2005 has been disclaimed.

[21] Appl. No.: 305,112

[22] Filed: Feb. 2, 1989

[30] Foreign Application Priority Data

Feb. 6, 1988 [GB] United Kingdom ..... 8802747

[51] Int. Cl.[5] ..... C14C 3/04

[52] U.S. Cl. ..... 8/94.29; 8/94.21; 8/94.27; 8/94.26; 8/94.19 R

[58] Field of Search ..... 8/94.19 R, 94.21, 94.27, 8/94.26, 94.29; 252/8.57

[56] References Cited

U.S. PATENT DOCUMENTS 4,731,089 3/1988 Covington ..... 8/94.19 R

*Primary Examiner*—Paul Lieberman
*Assistant Examiner*—John F. McNally
*Attorney, Agent, or Firm*—Banner, Birch, McKie & Beckett

[57] ABSTRACT

A leather tanning agent for use as a sole tannage or with another includes Al (III) ions, Ti (IV) ions and an organic masking agent in specific proportions. The ratio of Ti:Al expressed as metal oxides $TiO_2$:$Al_2O_3$ on a weight basis is from 0.6:1 to 2:1 and the amount of masking agent is from 0.1 to 0.4 mole per mole of total metal oxides. Preferably $SO_4$ ions are present.

Other metal tanning agents such as zirconium salts can be incorporated.

The tanning agent finds wide use and has an increased stability.

14 Claims, No Drawings

TANNING AGENT AND PROCESS

This invention relates to a tanning agent and a process of tanning leather using the tanning agent either as the sole tannage or in combination with another.

According to the present invention a leather tanning agent comprises a mixture of metal aluminium (III) ions and metal titanium (IV) ions with an organic masking agent in which the ratio Ti:Al expressed as metal oxides $TiO_2$:$Al_2O_3$ on a weight basis is from 0.6:1 to 2:1 and in which the amount of the masking agent is from 0.1 to 0.4 mole per mole of total metal oxides present in the mixture.

According to the present invention also a leather tanning process comprises bringing an animal skin into contact with a tanning agent according to the immediately preceding paragraph in aqueous solution.

As will be seen the tanning agents of the present invention are mixtures of at least two metal compounds providing metal Ti (IV) ions and metal Al (III) ions. Other metal ions may be present as desired and the invention embraces the presence, in addition to the Ti (IV) ions and Al (III) ions, of other tanning metal ions such as Cr (chromium) and Zr (zirconium).

The tanning agent of the present invention includes the metal Ti ions and the metal Al ions in the weight ratio of from 0.6:1 to 2:1 when expressed as metal oxides and any reference to "total metal oxides" in this specification shall be taken to include not only the oxides of Ti and of Al but also those of any other metals present in the tanning agent. Preferably it has been found that the tanning agent includes the Ti (IV) ions and Al (III) ions in the weight ratio of from 0.7:1 to 1.5:1 and more preferably 0.8:1 to 1:1.

The mixture of the Ti (IV) ions and Al (III) ions can be obtained by any appropriate method ranging from mixing two salts in solution to preparing in situ the dissolved ions by dissolution of Al oxide in an acid solution containing the Ti (IV) ions. For instance a mixture in aqueous solution can be prepared by dissolving say titanium sulphate and aluminium sulphate.

One easily available source of Ti (IV) ions is the well known "sulphate process" for the manufacture of titanium dioxide pigment in which a titaniferous ore is digested with concentrated sulphuric acid and the digestion cake obtained is dissolved in water or dilute sulphuric acid to produce a solution of titanyl sulphate and iron salts. After various clarification and reduction processes the solution is hydrolysed to precipitate a hydrous form of titanium dioxide leaving the iron salts in solution. The hydrous titanium dioxide can be washed as desired and dissolved in sulphuric acid to reform titanyl sulphate to be then mixed with a salt of aluminium such as aluminium sulphate in the proportions necessary to give the chosen ratio.

Alternatively aluminium oxide can be mixed with the dissolved hydrous titanium dioxide to react with residual sulphuric acid in the solution and generate the required Al (III) ions. If desired the Al (III) ions can be obtained from an added aluminium salt and can also be generated from added aluminium oxide.

Usually the masking agent is added to the prepared mixture of Ti (IV) ions and Al (III) ions although the agent can be added at any appropriate stage. The purpose of the addition of the masking agent is to increase the solubility of either the Ti ions, the Al ions or both in a tanning batch at a chosen pH and temperature thereby allowing efficient tanning to take place to result in an advantageous product. It is believed that the masking agent forms a complex compound with the ion or ions which compound may itself be based on a complex Ti/Al compound. However this invention does not rely for its usefulness on the correctness of this interpretation.

The masking agent which is used in the present invention can be any organic compound able to stabilise the metal ions in solution at a chosen pH. The presence of the agent protects the ions against precipitation by hydrolysis or by other means during the tanning process thereby allowing the ions to enter the animal skin and effect tanning. Typical masking agents are those organic compounds containing at least one carboxyl group and preferably one or more hydroxyl groups capable of reacting or complexing with one or both of the ions. Typical masking agents containing such named groups are the carboxylic or hydroxycarboxylic acids but usually their water soluble salts will be employed such as alkali metal salts of acetic, citric or tartaric acids.

Preferably, however, the organic masking agent is a salt of a polyhydroxy monocarboxylic acid. Preferably the salt has the general formula $$HOCH_2(CHOH)_n\ CO_2M$$

wherein M is an alkali metal and n has a value of 2 to 6. Sodium and potassium salts are preferred with their gluconates and glucoheptonates being especially preferred as the complexing masking agent.

The amount of the masking agent is from 0.1 to 0.4 mole per mole of total oxide present in the tanning agent and preferably from 0.25 to 0.35 mole per mole of total oxides. The precise amount required depends on various factors such as the desired tanning pH, the concentration of the metal ions in the tanning agent and the proportion of the metal ions in the tanning agent in use.

It has been found that the most preferred tanning agent contains an added source of sulphate ions. This source of sulphate ions is in addition to any resulting from the method of preparation of the mixed composition of Ti (IV) ions and Al (III) ions. It has been found to be advantageous to add sulphate ions in an amount of from 0.25 to 1.5 molar equivalent as $SO_4$ ions on total oxides. A suitable source is an alkali metal sulphate such as sodium or potassium sulphate.

The tanning agent of the present invention is usually formed as described, in aqueous solution and after preparation the agent can be sold in the form of a solution but preferably is dried to a powder containing at least the dried equivalents to the Ti (IV) using the Al (III) ions and the masking agent. If desired the additional source of sulphate ion can be added to the solution of the tanning agent before drying or on reconstitution of the agent at a tannery by dissolution in water.

Usually prior to drying or to sale as a solution the tanning agent is basified to a pH approximating to that of tanning. This basification can be carried out by adding to the tanning agent one or more bases and examples of these materials conventionally added for this purpose are the alkali metal bicarbonates or carbonates, ammonium bicarbonate or carbonate, magnesia or organic amines such as hexamethylenetetramine.

The tanning agents of the present invention can be used as the sole tannage or can be used in conjunction with other tanning agents either as mixtures or in separate tanning stages. For instance the tanning agent of the present invention can include a source of zirconium (IV) ions in addition to the Ti (IV) ions. Alternatively the tanning agent of the invention can be used in a preliminary tanning stage followed by completion of tanning with a conventional chromium tannage or vice versa.

Any type of animal skin can be tanned using the tanning agents of the present invention such as cattle (bovine) hides, sheep (ovine) skins, including wool skins, fellmongered skins and goat and deer skins.

Conventional wisdom suggests that, since titanium solutions are more prone to hydrolysis than those of aluminium, then their mixtures will behave in a similar manner. For example, for a mixture of a given weight of oxides in solution, it would be confidently predicted, and is indeed the case, that the higher the level of titanium in the mixture the lower the pH of permanent precipitation or turbidity.

It has been discovered however that, in the presence of certain masking agents, the susceptibility of such mixtures to hydrolysis shows a reversal of the expected trend with composition. At a given level of oxides, in the presence of a certain minimum level of masking agent, mixtures relatively richer in titanium show an increased resistance to hydrolysis over the entire composition range 0-100% $TiO_2$.

Further it has been discovered that the masking effect of excess sulphate ions persists even in the presence of the organic masking agent and that the masking effects are additive.

In this way it has been possible to produce tanning agent compositions involving Al and Ti ions, suitably stabilised by masking agents, which hitherto would have been considered impracticable in terms of their ability to withstand pH changes and dilutions without hydrolysis.

The following advantages of employing the herein specified range of amounts of ingredients:

1. Increased stability to hydrolysis with increasing $TiO_2$: $Al_2O_3$ ratio at the same overall oxide concentration.

| Example - At 0.4 molar Na gluconate (Na G) | |
|---|---|
| $TiO_2$:$Al_2O_3$ | Flocculation pH |
| 2.0 | 4.86 |
| 1.0 | 4.80 |
| 0.67 | 4.60 |
| 0.5 | 4.32 |

2. It is possible to use lower levels of masking agent and retain equivalent stability to hydrolysis

| Example - Flocculation at pH 4.6 | |
|---|---|
| $TiO_2$:$Al_2O_3$ | NaG conc$^n$ (moles/mole oxides) |
| 2.0 | 0.34 |
| 1.0 | 0.35 |
| 0.67 | 0.4 |
| 0.5 | 0.5 |

3. These lower levels of masking agent have a two-fold advantage
   (a) Cost
   (b) Less tendency to transfer the masking power to additional ions (e.g. $Cr^{3+}$) towards the end of tannage, and consequently less tendency to interfere with the normal Cr tanning mechanism.
4. Stability to hydrolysis can be further extended, if required by the addition of excess sulphate ion (e.g. $Na_2SO_4$). This extra stability persists in the presence of normal masking agent.

| Example - 1:1 $TiO_2$:$Al_2O_3$, oxide conc$^n$ 0.1 M | | |
|---|---|---|
| Additional $Na_2SO_4$(m) | NaG(m) | Flocculation pH |
| 0 | 0 | 2.13 |
| 0 | 0.35 | 4.02 |
| 1 | 0 | 2.56 |
| 1 | 0.35 | 4.40 |

Both $Na_2SO_4$ and NaG are molar equivalents to total oxides present.

5. In the preparation of 'wet-whites', a method of pretannage for skin preservation which offers increased final options to the tanner, there is an accumulation of excess Al in the tanning medium since, at 0.5 $TiO_2$:$Al_2O_3$ ratio there occurs preferential absorption of the Ti. This phenomenon tends to inhibit the re-use of the tanning bath in a recycling process. At high $TiO_2$:$Al_2O_3$ ratios the useful life of a tanning bath can be considerably extended since there is a smaller tendency for the imbalance to occur. The extent of this inbalance may vary with substrate but can be controlled by choice of $TiO_2$:$Al_2O_3$ ratio within the preferred range.

Other advantages arising from the use of increased proportions of the Ti(IV) ions are expected to be the smoothness of the tanned leather and compatibility with certain dyes and retannages.

The invention is illustrated in the following Examples.

EXAMPLE 1

Fresh hydrated titanium dioxide pulp derived from a conventional sulphate process route for making titanium dioxide pigment was mixed with water to produce a slurry. The slurry was heated at a temperature of approximately 140° to 145° C. with sulphuric acid to produce a clear solution of titanyl sulphate into which was dissolved iron-free aluminium sulphate in an amount such that the ratio $TiO_2$:$Al_2O_3$ is 1:1 by weight. Sodium gluconate was then added to produce a concentration in the solution of 0.35 molar with respect to the weight of total oxides present. The pH of the solution was then adjusted to 3.5 by adding sodium carbonate and the solution was spray dried. The spray dried product was then used to tan a dehaired sheepskin. The sheepskin after dehairing was pickled to a pH of 2.8 and liquid then drained from the sheepskin to which was then added 200% by weight of the sheepskin of a 5% by weight aqueous solution of common salt (NaCl). The sheepskin in the solution was stirred for a period of 30 minutes and then to the tanning bath was added the dried tanning powder in an amount sufficient to introduce 2% total oxides by weight of sheepskin. The mixture was stirred for 4 hours at room temperature and the temperature was then raised to 35° C. prior to further stirring for 12 hours at this elevated temperature. The pH was raised to a value within the range 4.0 to 4.5 by the addition of sodium bicarbonate solution over a period of 2 hours. Liquid was then drained from the sheepskin which was washed with water. The tanned sheepskin had a shrinkage temperature of 80° C.

EXAMPLE 2

Dewooled sheepskin was tanned conventionally with 33% basic Cr sulphate, but at the level of only 1% $Cr_2O_3$ offer to the pickled skin. This was immediately followed by a retannage with 1% offer of the masked titanium/aluminium reagent by the method of Example 1.

The tanned sheepskin had a shrinkage temperature in excess of 100° C.

EXAMPLE 3

Dewooled sheepskin was pretanned as described in Example 1 and retanned by the addition of 3% glutaraldehyde or pickled skin weight.

The finished sheepskin had a shrinkage temperature of 95° C.

I claim:

1. A leather tanning agent which comprises a mixture of metal aluminum (III) ions and metal titanium (IV) ions with an organic masking agent in which the ratio of $TiO_2$:$Al_2O_3$ on a weight basis is from 0.6:1 to 2:1 and in which the amount of the masking agent is from 0.1 to 0.4 mole per mole of total metal oxides present in the mixture, wherein said organic masking agent is a salt of a polyhydroxy monocarboxylic acid.

2. A leather tanning agent according to claim 1 in which the ratio of Ti:Al expressed as metal oxides on a weight basis is from 0.7:1 to 1.5:1.

3. A leather tanning agent according to claim 1 in which the ratio of Ti:Al expressed as metal oxides on a weight basis is from 0.8:1 to 1:1.

4. A leather tanning agent according to claim 1 in which the salt has the general formula $$HOCH_2(CHOH)_nCO_2M$$

wherein M is an alkali metal and n has a value of 2 to 6.

5. A leather tanning agent according to claim 4 in which the organic masking agent is selected from the class consisting of sodium gluconate, potassium gluconate, sodium glucoheptonate and potassium glucoheptonate.

6. A leather tanning agent according to claim 1 in which the amount of the masking agent is from 0.25 to 0.35 mole per mole of total metal oxides present in the mixture.

7. A leather tanning agent according to claim 1 in which the mixture also contains a source of sulphate ions.

8. A leather tanning agent according to claim 7 in which added sulphate ions are present in an amount of from 0.25 to 1.5 molar equivalent as $SO_4$ on total metal oxides present in the mixture.

9. A leather tanning agent according to claim 8 in which the source of sulphate ions is an alkali metal sulphate.

10. A leather tanning agent according to claim 1 in which the mixture also contains a source of chromium or zirconium ions.

11. A leather tanning agent according to claim 1 in which the mixture also contains a base.

12. A leather tanning agent according to claim 11 in which the base is selected from the class consisting of alkali metal bicarbonates, alkali metal carbonates, ammonium bicarbonate, ammonium carbonate, magnesia and organic amines.

13. A leather tanning process which comprises bringing an animal skin into contact with an aqueous solution of a leather tanning agent in accordance with any of the preceding claims.

14. A leather tanning process according to claim 13 in which at least a part of the tanning process is carried out employing a tanning agent containing a chromium salt.

* * * * *